US006108958A

United States Patent [19]

Kofoed

[11] Patent Number: 6,108,958

[45] Date of Patent: Aug. 29, 2000

[54] PICTURE FRAMING KIT

[76] Inventor: Bruce O. Kofoed, 7347 Elmridge Dr., Dallas, Tex. 75240

[21] Appl. No.: 08/996,822

[22] Filed: Dec. 23, 1997

[51] Int. Cl.[7] ..... A47G 1/06

[52] U.S. Cl. ..... 40/737; 40/798

[58] Field of Search ..... 40/737, 798, 799

[56] References Cited

U.S. PATENT DOCUMENTS

| | | | |
|---|---|---|---|
| 1,916,536 | 7/1933 | Slavin | 40/737 |
| 4,850,125 | 7/1989 | Green | 40/737 |
| 5,335,433 | 8/1994 | Borden | 40/737 |

*Primary Examiner*—Cassandra H. Davis

*Attorney, Agent, or Firm*—Peter A. Borsari

[57] ABSTRACT

A kit for framing pictures providing a user with a transparent or translucent overlay that may cover a picture in order to enhance its appearance and also to protect it from inadvertent contact with destructive substances such as water. The kit may provide a monolithic kit frame structure that consists of joined strips of a material such as glass, thermoplastic or epoxy which may be subject to coloring, texturing and sizing. The kit alternatively may provide the materials to form and join these customizable strips. The kit frame is directly affixable to a picture or may be used in addition to a standard picture frame. The kit further may comprise an additional viewing bubble to further enhance the appearance of a covered picture.

14 Claims, 4 Drawing Sheets

PICTURE FRAMING KIT

FIELD OF INVENTION

The present invention relates to the field of framing pictures, and more particularly to kit that provides a user with a transparent or translucent overlay that may cover a picture in order to enhance its appearance and also to protect it from inadvertent contact with destructive substances such as water. The kit comprises fused or joinable strips and/or sheets of a resinous or glass substance which may be directly affixed to a picture in order to form a transparent or translucent frame or which may be directly affixed to a glass pane covering a picture. In addition the strips and/or sheets may cover the border of the picture or may cover the picture entirely. The strips and/or sheets may be provided with numerous textures, colors or designs to further enhance their appearance.

BACKGROUND OF THE INVENTION

The present invention relates to the field of framing pictures such as paintings, photographs, photostatic copies, collages, posters, engravings, etchings etc. hereinafter referred to collectively as "pictures." It is commonly known to mat, to glaze and to frame pictures in order to increase their ornamental value. Moreover, it is commonly expected that displayed artwork will bear such ornamentation and aesthetic appeal. Custom framing of artwork can be very expensive since accurate cutting of matting and glazing materials and cutting and joining of framing materials require a high degree of skill by the framer. Even the raw materials such as wood and glass may be expensive depending on the quality and quantity required. The selection of both matting and framing materials must be made with an eye to choosing appropriate colors and designs so that the presence of these materials about the periphery of a picture is not a distraction, but rather, an enhancement of the picture's appearance.

Attempts have been made to provide decorative enhancements for pictures. For example, U.S. Pat. No. 2,520,347, issued Aug. 29, 1950 to A. G. Sachs shows an ornamental mounting for pictures comprising a planar pane of transparent material having a row of scallop-shaped hollows, a rear element of reflective material covering the area of the scalloped shapes. A picture may be positioned behind pane of material and held within the mounting by insertion into the hollows.

U.S. Pat. No. 5,025,579, issued Jun. 25, 1991 to B. D. Krueger discloses a picture frame comprising a plurality of opaque, colored mat layers permanently mounted within a base so that frame and matting are of a unitary construction.

U.S. Pat. No. 5,404,663 issued Apr. 11, 1995 to V. Z. Schober demonstrates an overlay comprising a core board of matting material having a beveled opening that may be placed over art work supported on a medium. A window board having an opening is placed over the overlay so that their respective openings are aligned whereafter the entire ensemble is placed within a frame.

U.S. Pat. No. 1,959,988, issued May 22, 1934 to H. A. Prew; U.S. Pat. No. 4,170,836, issued Oct. 16, 1979 to L. Seufert; U.S. Pat. Nos. 5,074,067, issued Dec. 24, 1991 and 5,279,880, issued Jan. 18, 1994 both to R. M. Cohart; and 5,286,558, issued Feb. 15, 1994 to T. Seo et al. each relate to the art of framing mats.

Despite the teachings of the prior art, a need still exists for providing a user with a simple and easy means by which to frame and decorate a picture. In addition, such a framing means should provide the user with numerous options such that the user may select an appearance which is most appealing to his eye and which enhances the picture's aesthetic appeal.

SUMMARY OF THE INVENTION

Accordingly, it is an object of the present invention to provide a kit for framing pictures by the use of which the aforementioned problems can be overcome and which comprises joined decorative strips of transparent or translucent material that may be directly attached to a picture in order to form a frame or that may be placed over a framed and glazed picture to enhance its appearance.

It is another object of the present invention to provide a kit for framing in which said strips of material may be personalized as by texturing, coloring or sizing by the user.

It is an additional object of the present invention to provide a kit for framing in which said strips of material may be further personalized by adhering backing paper to the translucent or transparent material such that the pattern or color of the backing paper is visible through the strips.

It is a still further object of the present invention to provide kit for framing which is economical to manufacture, durable in construction and effective in assembly and operation.

Additional objects, advantages and novel features of the present invention will be set forth in part in the description which follows and in part will become apparent to those skilled in the art upon examination of the following specification or may be learned by practice of the invention. To the accomplishment of the above-related objects, this invention may be embodied in the forms illustrated in the accompanying drawings, attention being called to the fact, however, that the drawings merely are illustrative, and that changes may be made in the specific construction illustrated and described within the scope of the appended claims.

BRIEF DESCRIPTION OF THE DRAWINGS

The present invention will be better understood with reference to the appended drawing sheets, wherein.

DETAILED DESCRIPTION

It will be appreciated that the present invention can take many forms and embodiments. Some embodiments of the invention are described so as to give an understanding of the invention. It is not intended that the illustrative embodiments described herein should limit the invention.

Figure 1:
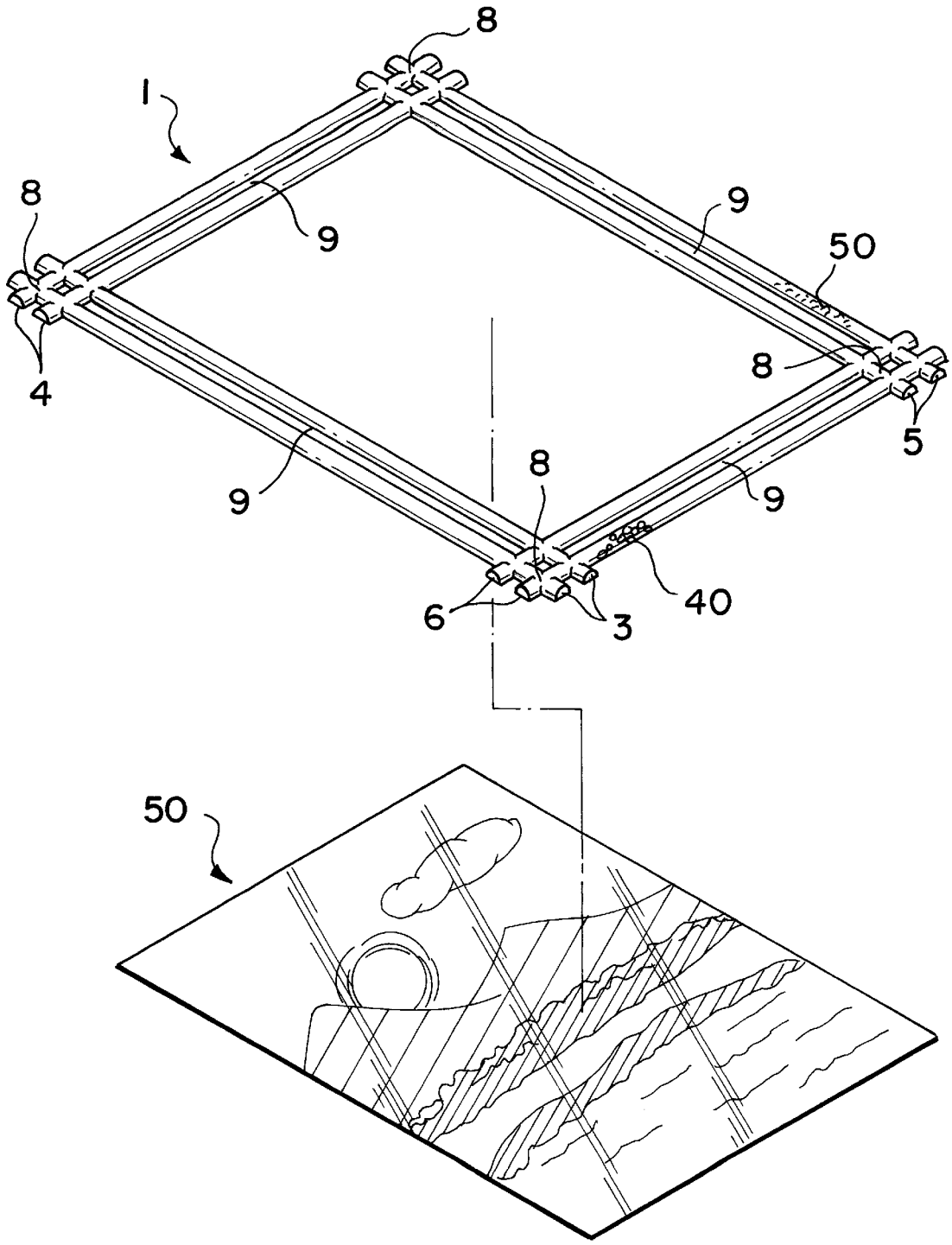
FIG. 1 is an exploded front perspective view of the picture framing kit of the present invention showing the resulting frame and a decorated piece of naked artwork.

Referring to the drawings, in particular FIG. 1, there is shown a picture 50 over which is lain the picture framing kit or kit frame of the instant invention 1. The picture generally will comprise some form of artwork having a front surface which is to be viewed and a back surface. Since the kit frame 1 is meant to enhance the view of the picture 50, only the front surface of the picture is relevant and the kit frame will always be affixed to this front surface. In this embodiment, the kit comprises two vertical strips 3 and 5 as well as two horizontal strips 4 and 6. The strips may be formed from transparent or translucent glass or from a colored or colorless resinous substance which sets as a solid such as a thermoplastic or epoxy resin. The substance may have a crystalline, frosted, pearlescent, glossy or matte finish or may exhibit any combination of these characteristics. The kit frame 1 may be used by the consumer either as assembled, whereby the term "assembled" means that the strips have been fused or joined by adhesive to one another at intersections 8 such that the user need only to affix the kit frame to a picture 50. Alternatively, the individual strips may be provided and joined by. appropriate means. For example, decorative strips of glass or hardened plastic may be sized to fit a desired picture 50 then joined to one another at intersections 8 by suitable means, including, for example, an adhesive, whereafter the kit frame 1 may be attached to the picture by adhesive or other means. It is intended that the dimensions of the kit frame 1, whether provided assembled form or in a form to be assembled, will have outer dimensions exceeding those of the picture 50 so that it will frame the picture. Where the strips are fabricated with a thermoplastic, the strips may be sized and lain atop one another in an appropriate configuration and then subjected to sufficient heat to cause fusing of the strips at the intersections 8, whereafter the kit frame 1 is again affixable to a picture. Epoxy strips may be extruded in the desired configuration and then left to cure as a monolithic structure affixable to the picture.

Figure 2:
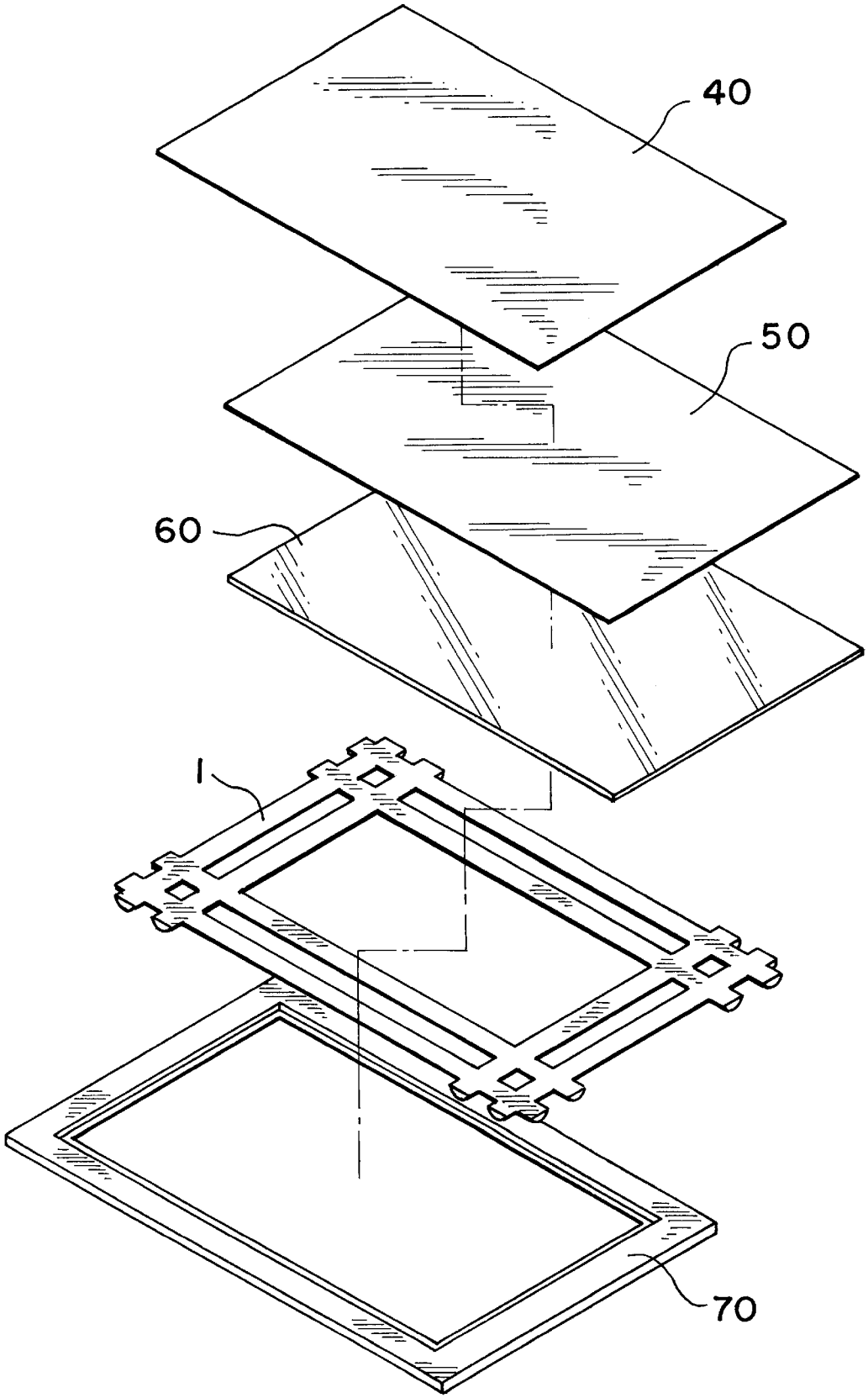
FIG. 2 is an exploded front perspective view of the picture framing kit of the present invention showing the application of the resulting frame as a further ornamentation to a piece of framed artwork.

Referring now to FIG. 2, a further use for the kit frame 1 is shown for a framed picture 50 having a backing 40, a glazing pane 60 and a standard frame 70. The kit frame 1 is sized so as to fit between the standard frame 70 and the glazing pane 60 and serves to highlight the picture 50 in the absence of a typical stock mat. The picture 50, backing 40 and glazing pane 60 may each have dimensions which are slightly smaller than those of the the kit frame 1.

Figure 3:
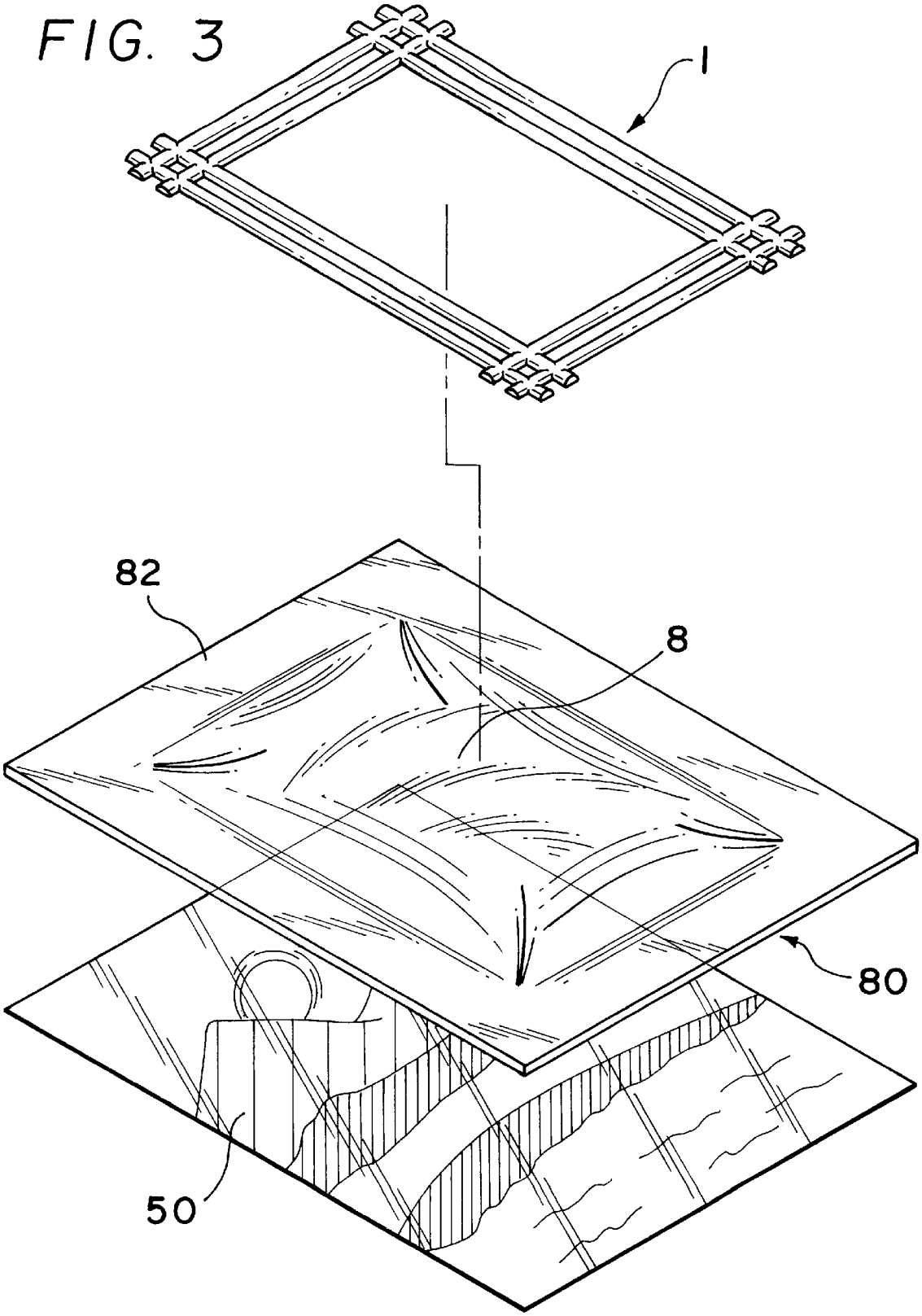
FIG. 3 is a side view of an alternative embodiment of the picture framing kit of the present invention.
Figure 5:
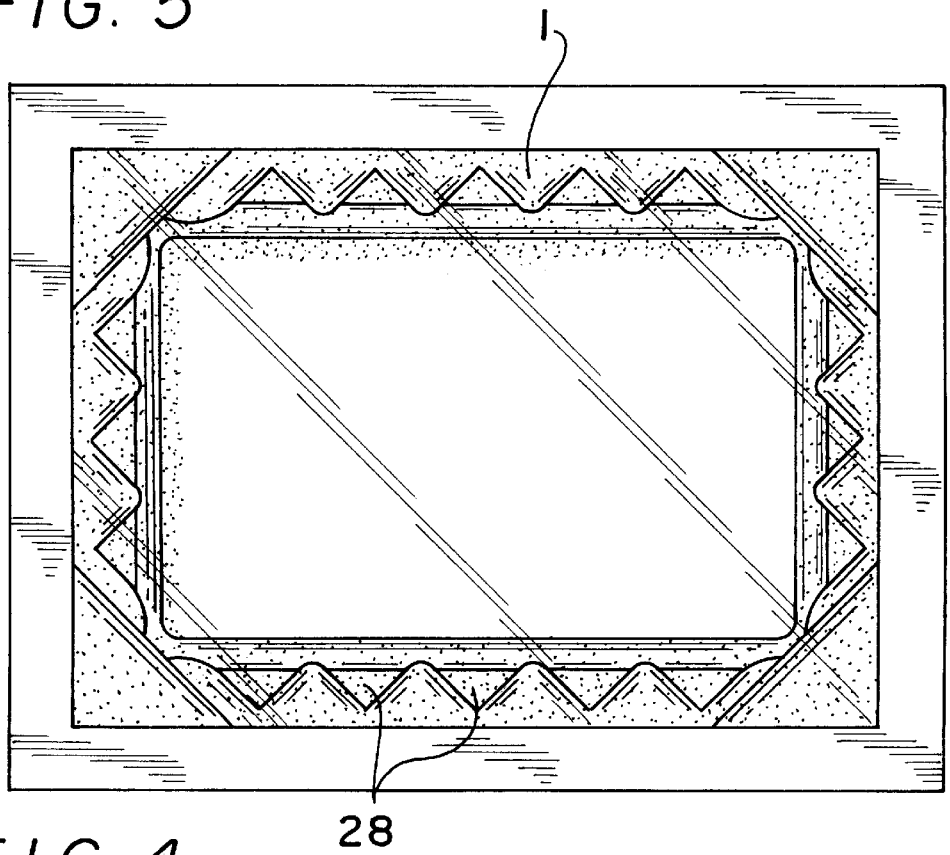
FIGS. 4 and 5 are front views of exemplary alternative embodiments of the kit frame of the present invention.
Figure 4:
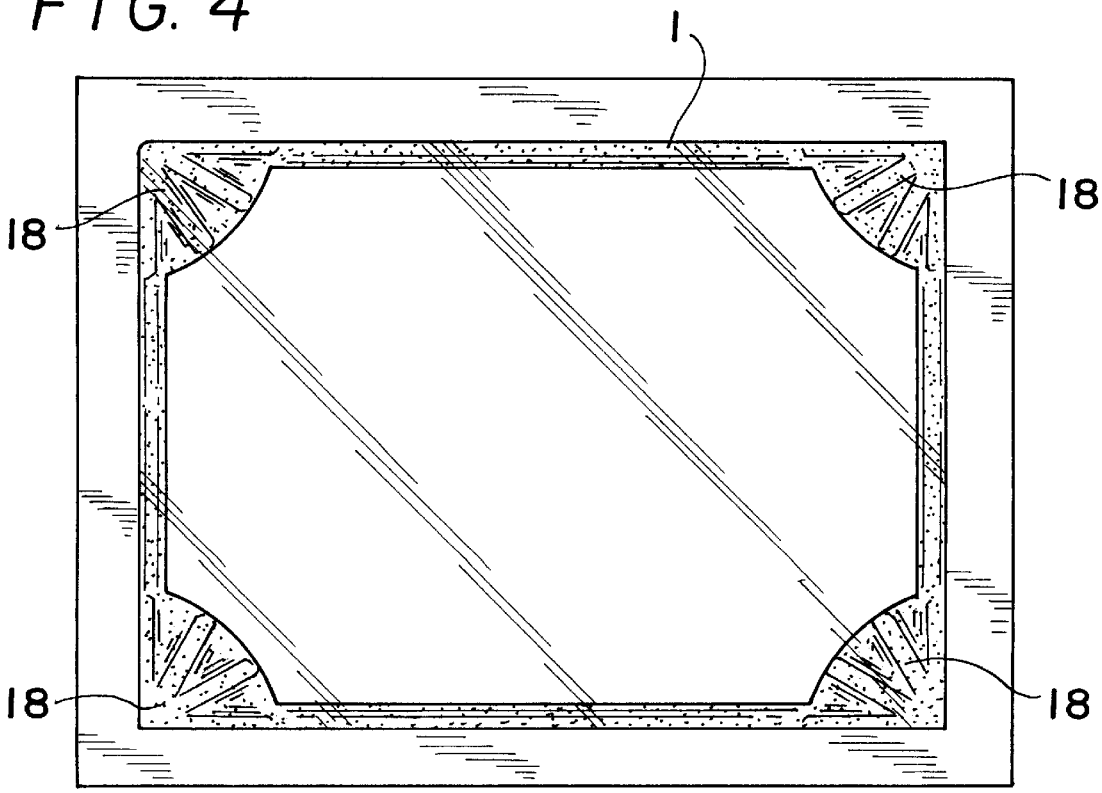

The kit frame 1 may be supplied with ancillary objects and materials that permit customization of the appearance of the strips. For example, small particulate objects 40 such as beads, rice, seeds, other plant matter, stones, colorful clays, paint chips, colored particles, etc. may be adhered to the strips or may be applied to either the thermoplastic strips or the epoxy strips prior to heating or curing. The resulting strips will have decorative elements either attached to the surface of the kit frame 1 or formed as integral parts of the kit frame. By using a translucent or transparent material in the construction of the strips, the kit frame 1 obviates the need by the user to match a matting color that will not conflict with the colors of the picture. However, if desired, the strips may exhibit an inherent color, or the user may customize this color by apply a dye, stain or ink thereto. In the most extreme use of color, the kit frame 1 may be rendered opaque. As illustrated in FIGS. 1–3, the kit frame 1 is not a solid structure but rather, each strip may be provided with numerous openings 9 which further allow the picture's colors to be seen. However, this is merely one configuration for the strips, as they may be produced to have any shape. Looking now to the exemplary alternative embodiment shown in FIG. 4, the kit frame 1 may be fabricated to so that interior corners 18 are scalloped. FIG. 5 demonstrates another exemplary embodiment in which the kit frame 1 is provided with numerous openings 28. Particularly where the kit frame 1 comprises strips to be made from epoxy, the user has almost unlimited discretion in forming the strips to a desired shape. Thermoplastic-containing kits for framing 1 may provide strips of varying width to produce kit frames producing a desired visual effect. Colorful papers such as a marbled Japan paper or wallpaper may be adhered to the strips to repeat the motif of a wall on which the picture 50 may be hung.

Referring now to FIG. 3, an alternative embodiment is shown comprising a kit frame 1 as in the previous embodiment and further comprising a transparent bubble frame 80 both of which are lain over a picture. The bubble frame comprises an essentially planar framing sheet 82, the center of which distends outwardly in a bulge 8. The bubble frame 80 is made from plastic materials and is subject to the same large variety of customizations as the kit frame 1.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A kit for framing a picture having a front surface comprising:

a plurality of strips fabricated from a see through material selected from the group consisting of glass, thermoplastics and epoxy resin, said each of said strips having a front surface, a planar rear surface, a first end and a second end, each first end of each of said plurality of strips being fused to a corresponding second end of another of said plurality of strips to form a kit frame having a front surface and a planar rear surface, said kit frame being affixable to the front surface of a picture in such a manner that said planar rear surface of said kit frame overlies and abuts the front surface of a picture;

ancillary materials for customizing said kit frame comprising coloring materials, particulate materials and fibrous materials; and attachment means capable of affixing said planar rear surface of said kit frame onto said front surface of a picture and of affixing said particulate materials and said fibrous materials to said front surface of said kit frame.

2. A kit frame for framing a picture according to claim 1, wherein said coloring materials are selected from the group consisting of dyes, stains and inks.

3. A kit for framing a picture according to claim 1 wherein said see through material has a finish selected from the group consisting of matte and glossy finishes.

4. A kit for framing a picture according to claim 1 wherein said see through material has a pearlescent appearance.

5. A kit for framing a picture according to claim 1 and further comprising a bubble frame, said bubble frame being an essentially planar framing sheet of a transparent material having a center, said center distending outwardly to form a bulge, said bubble frame being affixable over a picture and said kit frame being affixable over said bubble frame, whereby said picture will be viewable by a user through said kit frame and said bulge.

6. A kit for framing a picture having a front surface comprising:

a see through material selected from the group consisting of glass, thermoplastics and epoxy resin, said see through material being dimensionable to form a plurality of strips, each of said strips having a front surface, a rear planar surface, a first end and a second end, each first end of each of said plurality of strips being joinable to a corresponding second end of another of said plurality of strips to form a monolithic kit frame having a front surface and a planar rear surface, said kit frame being affixable to the front surface of a picture in such a manner that said planar rear surface of said kit frame overlies and abuts the front surface of a picture;

ancillary materials for customizing said kit frame comprising coloring materials, particulate materials and fibrous materials; and attachment means capable of affixing said planar rear surface of said kit frame onto said front surface of a picture and of affixing said particulate materials and said fibrous materials to said front surface of said kit frame.

7. A kit frame for framing a picture according to claim 6 wherein said coloring materials are selected from the group consisting of dyes, stains and inks.

8. A kit for framing a picture according to claim 6 wherein said see through material has a finish selected from the group consisting of matte and glossy finishes.

9. A kit for framing a picture according to claim 6 wherein said see through material has a pearlescent appearance.

10. A kit for framing a picture according to claim 6 and further comprising a bubble frame, said bubble frame being an essentially planar framing sheet of a transparent material having a center, said center distending outwardly to form a bulge, said bubble frame being affixable over a picture and said kit frame being affixable over said bubble frame, whereby said picture will be viewable by a user through said kit frame and said bulge.

11. A method for framing a picture having a front surface for viewing comprising the steps of affixing a bubble frame characterized as being an essentially planar framing sheet of a transparent material having a center distending outwardly to form a bulge over the front surface of said picture and affixing a kit frame according to claim 6 over said bubble frame.

12. A method for framing a picture having a front surface for viewing and having a standard frame comprising the step of affixing a kit frame to the front surface of said picture, said kit frame being inserted between said standard frame and said picture, wherein said kit frame comprises (1) a plurality of strips fabricated from a see through material selected from the group consisting of glass, thermoplastics and epoxy resin, said each of said strips having a first end and a second end, each first end of each of said pluarlity of strips being fused to a corresponding second end of another of said plurality of strips to form said kit frame and (2) ancillary materials for customizing id kit frame.

13. A method for framing a picture having a front surface for viewing and having a standard frame comprising the step of affixing a kit frame to the front surface of said picture, said kit frame being inserted between said standard frame and said picture, wherein said kit frame comprises (1) a see through material selected from the group consisting of glass, thermoplastics and epoxy resin, said see through material being dimensionable to form a plurality of strips, each of said strips having a first end and a second end, each first end of each of said pluarlity of strips being joinable to a corresponding second end of another of said plurality of strips to form a monolithic kit frame and (2) ancillary materials for customizing said kit frame.

14. A method for framing a picture having a front surface for viewing and having a standard frame comprising the steps of affixing a bubble frame having an essentially planar framing sheet of a transparent material having a center, said center distending outwardly to form a bulge over the front surface of said picture;

affixing a kit frame comprising (1) a plurality of strips fabricated from a see through material selected from the group consisting of glass, thermoplastics and epoxy resin, said each of said strips having a first end and a second end, each first end of each of said pluarlity of strips being fused to a corresponding second end of another of said plurality of strips to form said kit frame and (2) ancillary materials for customizing said kit frame; and inserting said bubble frame and said kit frame between said standard frame and said picture.

* * * * *